US009698481B2

(12) United States Patent
Mikata

(10) Patent No.: US 9,698,481 B2
(45) Date of Patent: Jul. 4, 2017

(54) CHIP ANTENNA AND COMMUNICATION CIRCUIT SUBSTRATE FOR TRANSMISSION AND RECEPTION

(71) Applicant: TAIYO YUDEN CO., LTD., Tokyo (JP)

(72) Inventor: Jin Mikata, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 244 days.

(21) Appl. No.: 14/486,727

(22) Filed: Sep. 15, 2014

(65) Prior Publication Data

US 2015/0116179 A1 Apr. 30, 2015

(30) Foreign Application Priority Data

Oct. 30, 2013 (JP) ..... 2013-224955

(51) Int. Cl.

| | |
|---|---|
| ***H01Q 5/00*** | (2015.01) |
| ***H01Q 5/371*** | (2015.01) |
| ***H01Q 1/22*** | (2006.01) |
| ***H01Q 1/24*** | (2006.01) |
| ***H01Q 1/38*** | (2006.01) |
| ***H01Q 9/42*** | (2006.01) |

(52) U.S. Cl.

CPC ..... *H01Q 5/371* (2015.01); *H01Q 1/2291* (2013.01); *H01Q 1/243* (2013.01); *H01Q 1/38* (2013.01); *H01Q 9/42* (2013.01)

(58) Field of Classification Search

CPC ..... H01Q 1/2291; H01Q 1/243; H01Q 1/38; H01Q 5/371; H01Q 9/42

USPC ..... 343/845

See application file for complete search history.

(56) References Cited

U.S. PATENT DOCUMENTS

| | | | | |
|---|---|---|---|---|
| 5,760,746 A * | 6/1998 | Kawahata | ..... | H01Q 1/38 343/700 MS |
| 5,861,854 A * | 1/1999 | Kawahata | ..... | H01Q 1/243 343/700 MS |
| 5,867,126 A * | 2/1999 | Kawahata | ..... | H01Q 1/243 343/700 MS |
| 5,959,582 A * | 9/1999 | Kawahata | ..... | H01Q 1/243 343/700 MS |

(Continued)

FOREIGN PATENT DOCUMENTS

| | | |
|---|---|---|
| JP | 3114582 B2 | 12/2000 |
| JP | 2001-7639 A | 1/2001 |

(Continued)

OTHER PUBLICATIONS

Japanese Office Action dated Dec. 18, 2014, in a counterpart Japanese patent application No. 2013-244955.

*Primary Examiner* — Dameon E Levi
*Assistant Examiner* — Ab Salam Alkassim, Jr.
(74) *Attorney, Agent, or Firm* — Chen Yoshimura LLP

(57) ABSTRACT

A first radiating electrode of a split ring resonator type is formed on a side face of a substrate of a rectangular cuboid antenna device so as to be at a right angle to a ground electrode surface, a second radiating electrode is provided on a top surface of the substrate, the first radiating electrode and the second radiating electrode are capacitively coupled, and the resonance frequency of the first radiating electrode and second radiating electrode are configured to be approximately in symmetry with the central frequency of the used frequency.

6 Claims, 18 Drawing Sheets

(56) References Cited

U.S. PATENT DOCUMENTS

| | | | | |
|---|---|---|---|---|
| 6,281,848 | B1 * | 8/2001 | Nagumo | H01Q 1/243 343/700 MS |
| 6,433,745 | B1 * | 8/2002 | Nagumo | H01Q 1/243 343/700 MS |
| 6,433,746 | B2 * | 8/2002 | Kushihi | H01Q 1/243 343/700 MS |
| 6,683,571 | B2 * | 1/2004 | Ghosh | H01Q 1/243 343/700 MS |
| 6,700,543 | B2 * | 3/2004 | Konishi | H01Q 1/38 343/700 MS |
| 6,707,427 | B2 * | 3/2004 | Konishi | H01Q 1/243 343/700 MS |
| 6,753,813 | B2 * | 6/2004 | Kushihi | H01Q 1/22 343/700 MS |
| 7,136,020 | B2 * | 11/2006 | Yamaki | H01Q 9/285 343/700 MS |
| 7,916,086 | B2 * | 3/2011 | Koskiniemi | H01Q 1/38 343/700 MS |
| 9,203,154 | B2 * | 12/2015 | Korva | H01Q 1/243 |
| 2002/0145569 | A1 * | 10/2002 | Onaka | H01Q 1/22 343/702 |
| 2011/0074641 | A1 * | 3/2011 | Sotoma | H01Q 1/243 343/702 |
| 2011/0109510 | A1 * | 5/2011 | Onaka | H01Q 1/243 343/700 MS |

FOREIGN PATENT DOCUMENTS

| | | | |
|---|---|---|---|
| JP | 2011-77714 | A | 4/2011 |
| JP | 2011-101232 | A | 5/2011 |

* cited by examiner

CHIP ANTENNA AND COMMUNICATION CIRCUIT SUBSTRATE FOR TRANSMISSION AND RECEPTION

BACKGROUND OF THE INVENTION

Field of the Invention

The present invention relates to a chip antenna with a ground installed that can be widely used for wireless LAN, Bluetooth, cell phones, and the like; and a communication circuit substrate for transmission and reception that has the chip antenna installed.

Description of Related Art

Recently, as electronic devices are being reduced in size to improve portability, more and more electronic devices are being mounted with wireless capabilities (wireless LAN, Bluetooth, and the like) to communicate with such electronic devices. As a result, the demand for an antenna mounted on the communication circuit substrate for transmission and reception of an electronic device that occupies a smaller area within the circuit substrate is rising.

With this kind of demand, a reduction in the size of the antenna device is desired. This is the background to why chip antennas including the one disclosed in Japanese Patent Application Laid-Open Publication No. 2011-101232 (Patent Document 1) have been developed. This kind of antenna device inhibits the reduction in size of the antenna device because the possible layout of the substrate components is limited because the ground electrode of the substrate in the portion where the antenna device is mounted needs to be removed in order to express the characteristics of the antenna device.

Also, if a radiating electrode is arranged so as to be parallel to a ground electrode, the magnetic field generated by the radiating electrode enters the ground electrode and generates an induction current. The effect of the magnetic field generated by the induction current cancels the current flowing into the radiating electrode and dissipates the current as heat. The resulting problem is that the performance of the antenna deteriorates unless there is enough distance between the radiating electrode and the ground electrode.

The invention disclosed in Japanese Patent Application Laid-Open Publication No. 3114582 (Patent Document 2) was invented to solve such a problem. The chip antenna in this invention can be mounted on the ground electrode and thus contribute to the size reduction. Specifically, this is an antenna device in which the tip of the excitation electrode and the open end of the radiating electrode formed so as to be parallel to the ground electrode is capacitively coupled at a gap, and a terminal side of the radiating electrode is connected to the ground electrode.

RELATED ART DOCUMENTS

Patent Documents

Patent Document 1: Japanese Patent Application Laid-Open Publication No. 2011-101232

Patent Document 2: Japanese Patent No. 3114582

SUMMARY OF THE INVENTION

As mentioned above, it is known that the performance of the antenna device according to Patent Document 1 is reduced when a conductor such as the ground surface gets closer to the antenna device. As a result, a ground pattern and the like could not be arranged around the antenna.

On the other hand, the antenna device according to Patent Document 2 can obtain excellent antenna characteristics by using an antenna mounted on a surface of a rectangular cuboid block provided with strip line electrodes without cutting out a print pattern. Thus, the inner layer substrate directly below the antenna can also be used for wiring lines and as a result the area occupied by the antenna is reduced.

However, the antenna device according to Patent Document 2 has a problem that the frequency band in which an excellent impedance matching can be obtained is narrow.

The antenna device 4 according to Patent Document 2 shown in FIGS. 15 to 17 has a rectangular block 41 made of dielectric substances such as ceramics and resin, or magnetic bodies, and a strip line-shaped radiating electrode 42 with a length similar to λ/4 on a top surface 41*a* of the block. One end of a radiating electrode 42 extends to a vicinity of one side and forms an open end, and the other end goes over a side face 41*e* and connects to the ground electrode 43 formed on a bottom surface. Also, an excitation electrode 44 is formed with an open end of the radiating electrode 42 and a gap g. The excitation electrode 44 extends to the bottom surface 41*f* of the block 41 from the side face 41*c* opposing the side face 41*e*, and the excitation electrode 44 is electrically insulated from the ground electrode 43 by the body of the block. Then, the excitation electrode 44 and the radiating electrode 42 are electromagnetically coupled by the capacitance formed in the gap g.

The circuit substrate for transmission and reception 5 mounted with the antenna device 4 is provided with a high frequency circuit 51 and a transmission line 53 that connects the output of the high frequency circuit 51 and the feed land 52.

By connecting a feed terminal 45 provided on the bottom surface 41*f* of the antenna device 4 with the feed land 52 of the circuit substrate 5, the excitation electrode 44 is connected to the output of the high frequency circuit 51 through the transmission line 53.

The entire surface of the ground electrode 43 formed on the bottom surface of the antenna device 4 is connected to the ground surface 54 of the circuit substrate 5. Additionally, the other end of the radiating electrode 42 of the antenna device 4 is connected to the ground electrode 54.

FIG. 18 shows the results of an electromagnetic field simulation for the VSWR (Voltage Standing Wave Ratio) properties of the abovementioned antenna device 4 designed for the 2.4 GHz band. According to the results, the VSWR is equal to or less than four for frequency bands of approximately 30 MHz, and the VSWR was equal to or less than three for frequency bands of approximately 23 MHz. The frequency band in which an excellent impedance matching can be obtained is very narrow compared to the antenna with the ground electrode removed as in Patent Document 1 in which the frequency band with a VSWR that is four or less can obtain at least 100 MHz.

In this manner, the antenna device of the related art can reduce the area of the substrate, but generates a new problem in which the frequency range where excellent impedance matching can be obtained is narrowed.

The present invention was made in view of the abovementioned problem and aims to propose a chip antenna that can be mounted on the ground electrode surface of the communication circuit substrate for transmission and reception and has a wider frequency range that can obtain excellent impedance matching compared to conventional configurations, and a communication circuit substrate for transmission and reception that has this antenna device installed.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a chip antenna including: a block having a rectangular cuboid shape; a feed terminal pad formed on a bottom surface of the block at a side of the bottom surface; a ground electrode formed on an area on the bottom surface of the block; an electrically insulated area formed on the bottom surface of the block so as to separate the feed terminal pad with the ground electrode; an excitation electrode that has one end on a side face of the block, the end being connected to the feed terminal pad on the bottom surface, the excitation electrode extending from a bottom portion of the side face of the block towards a top surface of the block; a first radiating electrode of a split ring resonator type having two open ends, the first radiating electrode having a capacitively coupled portion formed by arranging two open end portions defining a slit on the another side face of the block, the first radiating electrode having a prescribed portion connected to another end of the excitation electrode; a second radiating electrode having two ends, one end being connected to the ground electrode and another end being open, and in which at least a central portion of the second radiating electrode is formed on the top surface of the block and an open end portion of the second radiating electrode forms a slit with a portion of the first radiating electrode, the open end portion forming a capacitively coupled portion between the first radiating electrode and the open end portion, wherein a resonance frequency of the first radiating electrode and a resonance frequency of the second radiating electrode are configured to be different from each other.

In another aspect, the present disclosure provides a communication circuit substrate for transmission and reception including a ground electrode formed on a surface of the communication circuit substrate for transmission and reception, and wherein the chip antenna is mounted on the substrate so that the ground electrode of the chip antenna and the ground electrode of the substrate are electrically connected.

According to the chip antenna and the communication circuit substrate for transmission and reception of the present invention, by installing the antenna device to the substrate so as to connect the ground electrode surface of the substrate surface and the ground electrode surface of the bottom surface of the antenna device when installing the chip antenna to the communication circuit substrate for transmission and reception, the magnetic flux generated by the first radiating electrode formed on one side face of the block becomes approximately parallel to the ground electrode surface of the substrate, and thus the magnetic field that enters the ground electrode surface of the substrate can be reduced. As a result, the antenna efficiency can be improved without electricity emitted from the antenna device being cancelled out because the inductive current induced to the ground electrode surface of the substrate can be reduced and the effect of the first radiating electrode cancelling the magnetic field entering the ground electrode surface of the substrate can be reduced. Also, the frequency range in which excellent impedance matching can be obtained can be broadened without increasing the area of the substrate that the antenna device occupies.

It is to be understood that both the foregoing general description and the following detailed description are exemplary and explanatory, and are intended to provide further explanation of the invention as claimed.

DETAILED DESCRIPTION OF THE PREFERRED EMBODIMENTS

An embodiment of the present invention will be explained below with reference to figures.

Figure 1:
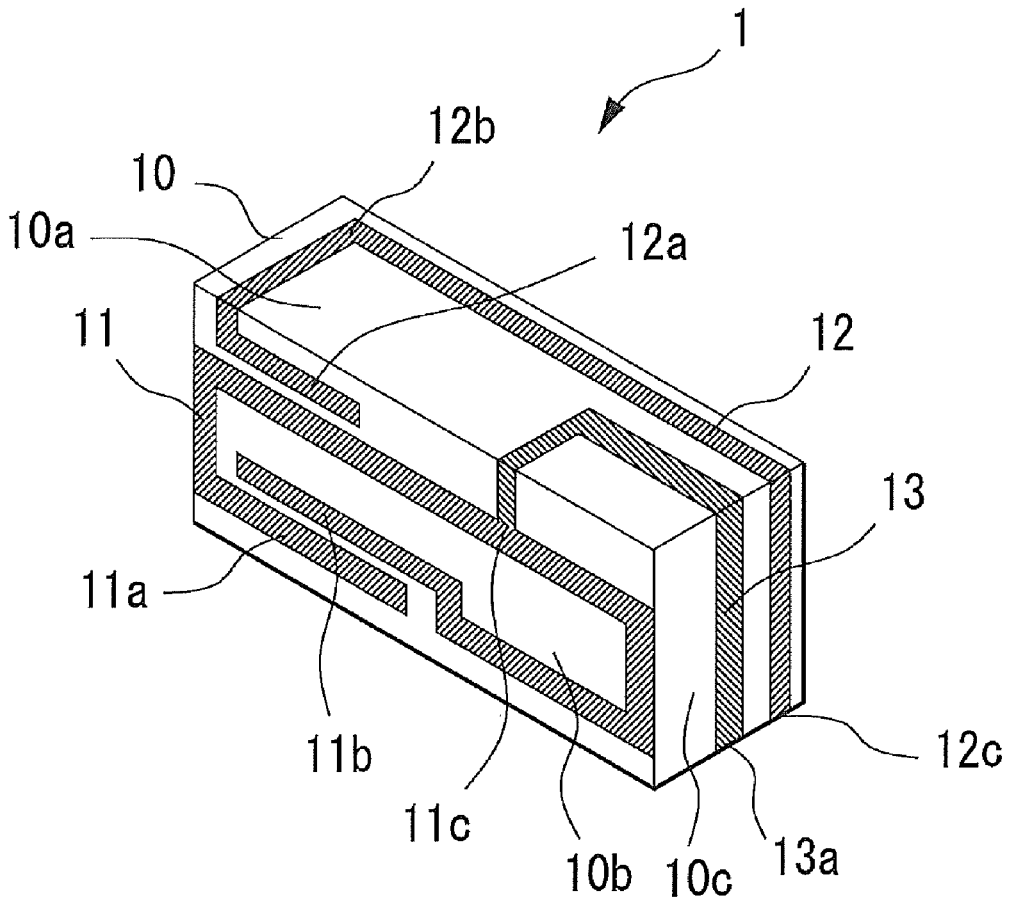
FIG. 1 is an exterior perspective view showing a chip antenna of Embodiment 1 of the present invention.
Figure 2:
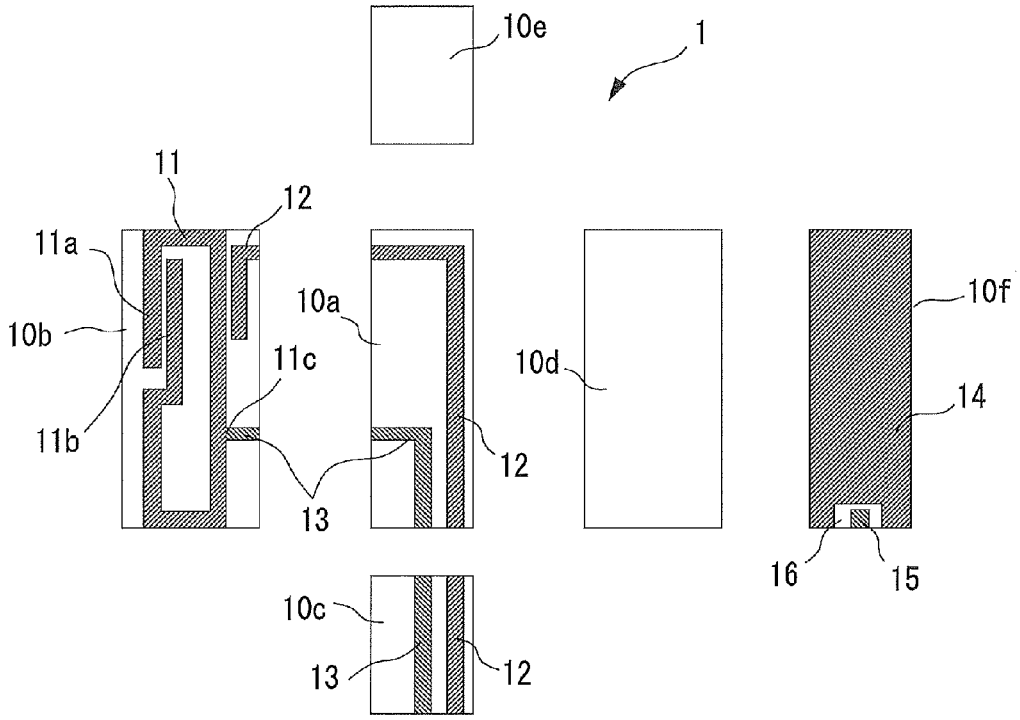
FIG. 2 is an expansion plan showing each surface of the chip antenna of Embodiment 1 of the present invention.

As shown in FIGS. 1 and 2, an antenna device 1 has a first radiating electrode 11 that is a loop-shaped conductor, a second radiating electrode 12 that is a linear conductor, an excitation electrode 13 that is a linear conductor, a ground electrode 14, a feed terminal pad 15, and the like formed on the surface of a rectangular cuboid block 10 formed of a dielectric body.

The block 10 is formed of a dielectric block of length 9 mm×width 3 mm×height 4 mm and permittivity 8, for example. Also, the size of the antenna can be reduced by arranging the electrodes of each conductor on the surface of the dielectric body by a wavelength shortening effect. This will not be explained as it is well known.

The first radiating electrode 11 is a split-ring resonator with a first capacitively coupled portion inserted in a loop-shaped conductor arranged on another side face 10*b* of the block 10. The first radiating electrode 11 has a first resonance frequency f1 caused by the inductance of the loop-shaped conductor forming an electrode and the capacitance of the first capacitively coupled portion. Also, the first capacitively coupled portion is formed by arranging both open end portions 11*a* and 11*b* of the first radiating electrode to be in parallel with a slit therebetween.

The second radiating electrode 12 is arranged so that the central portion thereof is disposed on the top surface 10*a* of the block 10 so that an open end portion of an end of the second radiating electrode is formed on the other side face (another side face) 10*b* where the first radiating electrode 11 is formed, and is arranged in parallel so that a slit is formed on a portion of the loop-shaped conductor of the first radiating electrode 11. As a result, a second capacitively coupled portion is formed between a portion of the loop-shaped conductor of the first radiating electrode 11 and an open end portion 12*a* of the second radiating electrode 12.

Also, the second radiating electrode 12 is arranged so as to extend from the open end portion 12*a*, through a "U"-shaped turning portion 12*b* of the top surface 10*a* of the block 10, to a side face 10*c* of the block 10. Another end 12*c* of the second radiating electrode 12 is connected to the ground electrode 14 formed on the bottom surface 10*f* of the block 10.

Also, the second radiating electrode 12 has a second resonance frequency f2 caused by the inductance of the linear conductor of the second radiating electrode 12 and the capacitance of the second capacitively coupled portion on the side with the open end portion 12*a*. Furthermore, the first resonance frequency f1 and the second resonance frequency f2 are set so as to be slightly different. Also, it is preferable that the first resonance frequency f1 and the second resonance frequency f2 be set so as to be in approximate symmetry with the central frequency of the used frequency band. The central frequency of the used frequency is 2.45 GHz for the present embodiment.

The excitation electrode 13 has an end 13*a* connected to the feed terminal pad 15 formed on the bottom surface 10*f* of the block 10, and the excitation electrode starts from a side face 10*c* and goes through a top surface 10*a* towards the other side face 10*b* where the other end is connected to the first radiating electrode 11 at a prescribed portion 11*c*. In addition, an electrically insulated area 16 is formed around the feed terminal pad 15, which causes the feed terminal pad 15 to be electrically insulated from the ground electrode 14.

Next, the operation of the antenna device for the present embodiment will be explained.

Figure 3:
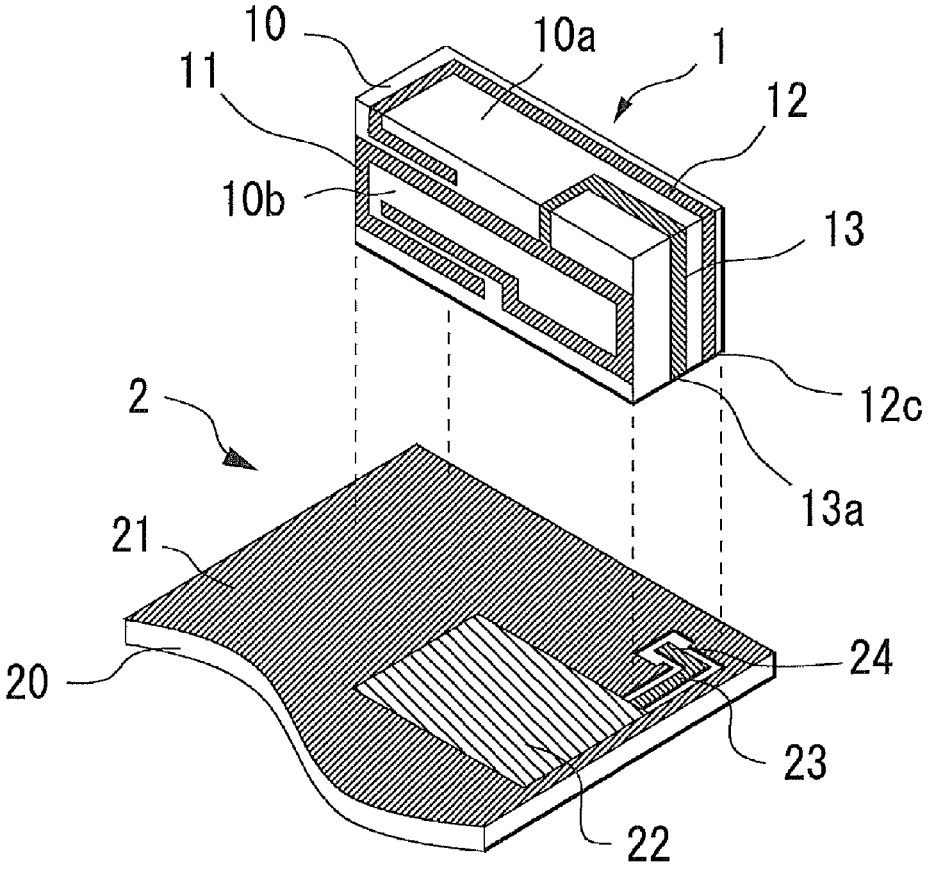
FIG. 3 shows a method of installing the chip antenna of Embodiment 1 of the present invention to a communication circuit substrate for transmission and reception.
Figure 4:
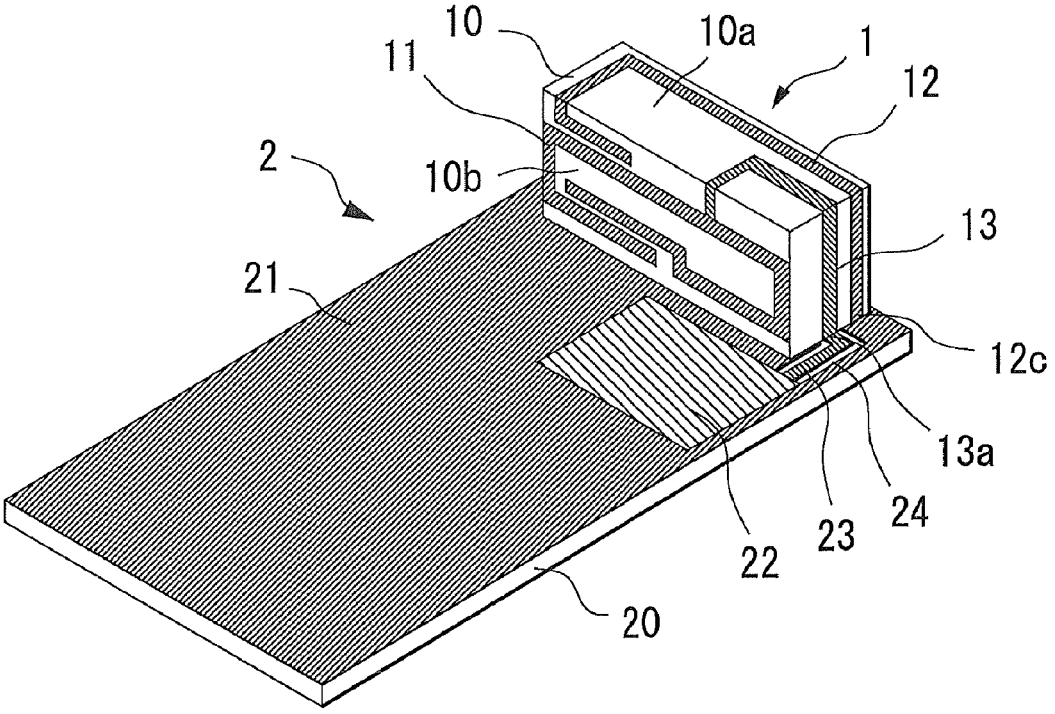
FIG. 4 is an exterior perspective view showing the communication circuit substrate for transmission and reception with the chip antenna of Embodiment 1 of the present invention.

As shown in FIGS. 3 and 4, when the antenna device 1 is mounted on the communication circuit substrate for transmission and reception (hereinafter, referred to as substrate) 2, the ground electrode 14 on the bottom surface 10*f* of the antenna device 1 and the second radiating electrode 12 are connected to a ground electrode surface 21.

The reason for providing the ground electrode 14 on the bottom surface 10*f* of the antenna device 1 with a wide area is mainly to secure mechanical strength and to reduce the effect of variations in the locations where the antenna device 1 is mounted to the substrate 2. In addition, the scale of the substrate in the present embodiment is 24×13 mm.

Furthermore, by connecting the feed terminal pad 15 provided on the bottom surface 10*f* of the antenna device 1 with a feed land 24 provided on the surface of the block 20 of the substrate 2, the excitation electrode 13 is connected to the output of the high frequency circuit 22 through a transmission line 23. Here, the transmission line 23 is arranged on the surface of the substrate 2 for easy understanding, but the transmission line may also be arranged on the inner layer or on the bottom surface of the base 20.

In general, the output impedance of the high frequency circuit 22 is set at 50 ohm, but the input impedance of the antenna device 1 is not necessarily 50 ohm and varies depending on any or all of the form, the design, or the installation environment, and if connected as is, the impedance mismatch often causes loss. Thus, usually an impedance matching circuit is inserted in the transmission line 23 to make the impedance match 50 ohm, but the impedance matching circuit is not shown in the explanation of the present embodiment.

Figure 5:
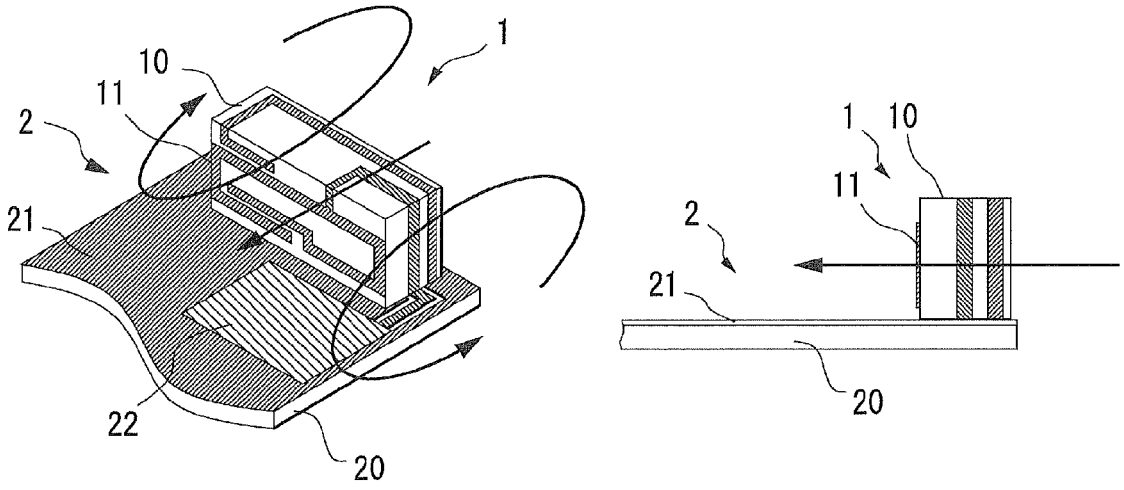
FIG. 5 explains the magnetic field that is generated by the first radiating electrode of the chip antenna of Embodiment 1 of the present invention.

Next, the first radiating electrode 11 and the excitation electrode 13 will be explained with reference to the schematic view of the magnetic field distribution as generated by the first radiating electrode 11 shown in FIG. 5.

The excitation electrode 13 is connected to the first radiating electrode 11 and supplies the output of the high frequency circuit 22 to the first radiating electrode 11.

The first radiating electrode 11 is a split ring resonator in which a first capacitively coupled portion is inserted in the loop-shaped electrode and is equivalent to the resonance circuit of the inductor and the capacitor. The first resonance frequency f1 can be adjusted by the length of the loop-shaped electrode and the capacitance of the first capacitively coupled portion.

Also, if the antenna device 1 is mounted on the substrate 2, the other side face 10*b* of the first radiating electrode 11 becomes perpendicular to the ground electrode surface 21 formed on the surface of the block 20 of the substrate 2.

Here, the reason for arranging the first radiating electrode 11 perpendicular to the ground electrode surface 21 of the substrate 2 will be described.

The magnetic flux generated by the first radiating electrode 11 formed on the other side face 10*b* of the block 10 is approximately parallel to the ground electrode surface 21 of the substrate 2, and thus the magnetic field entering the ground electrode surface 21 of the substrate 2 can be reduced. As a result, the antenna efficiency can be improved without electricity emitted from the antenna device 1 cancelling each other out, because the inductive current induced to the ground electrode surface 21 of the substrate 2 can be reduced and the effect of the first radiating electrode cancelling the magnetic field entering the ground electrode surface of the substrate can be reduced.

Figure 6:
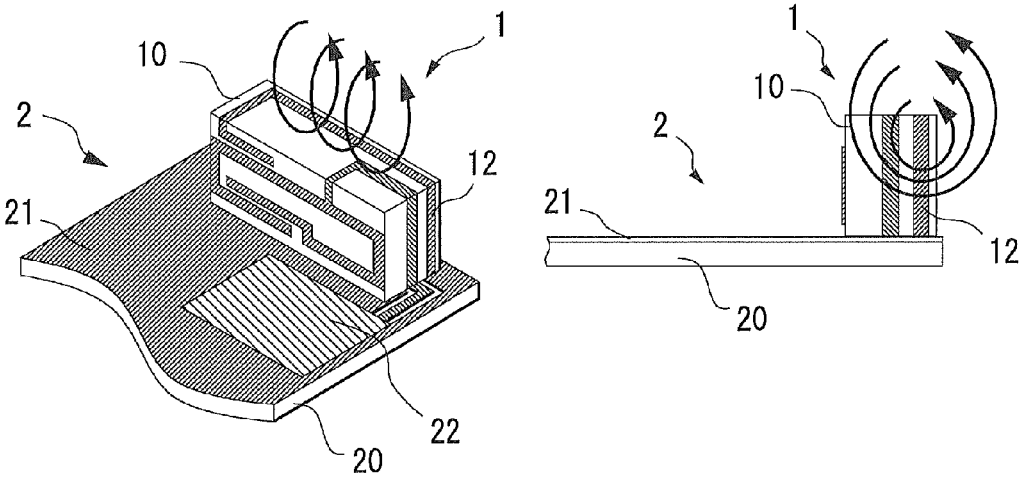
FIG. 6 explains the magnetic field that is generated by the second radiating electrode of the chip antenna of Embodiment 1 of the present invention.

Next, the second radiating electrode 12 will be described using a schematic view shown in FIG. 6 of the magnetic field distribution generated by the second radiating electrode 12.

The second radiating electrode 12 is coupled with the first radiating electrode 11 through a second capacitively coupled part formed with the open end portion 12*a* of the second radiating electrode and a portion of the first radiating electrode 11, and the other end of the second radiating electrode is connected to the ground electrode 14.

The resonance frequency f2 of the second radiating electrode 12 can be adjusted by the length of the linear conductor of the second radiating electrode 12 and the capacitance of the second capacitively coupled portion.

The second radiating electrode 12 is a linear antenna where a ring-shaped magnetic field is generated when a current flows; similar to linear antennas in a monopole antenna, dipole antenna, and the like. If the ground electrode surface 21 of the substrate 2 gets very close to the second radiating electrode 12, then a portion of the ring-shaped magnetic field enters and causes loss due to the aforementioned inductive current problem. Therefore, a certain amount of distance between the ground electrode surface 21 of the substrate 2 and the second radiating electrode is needed, and it is preferable that the main parts of the second radiating electrode 12 including the central part be arranged on the top surface 10*a* of the block 10.

Also, as mentioned above, by adjusting the resonance frequency f1 of the first radiating electrode 11 and the resonance frequency f2 of the second radiating electrode 12 to be slightly different, excellent antenna characteristics can be obtained in a wider frequency band.

Figure 7:
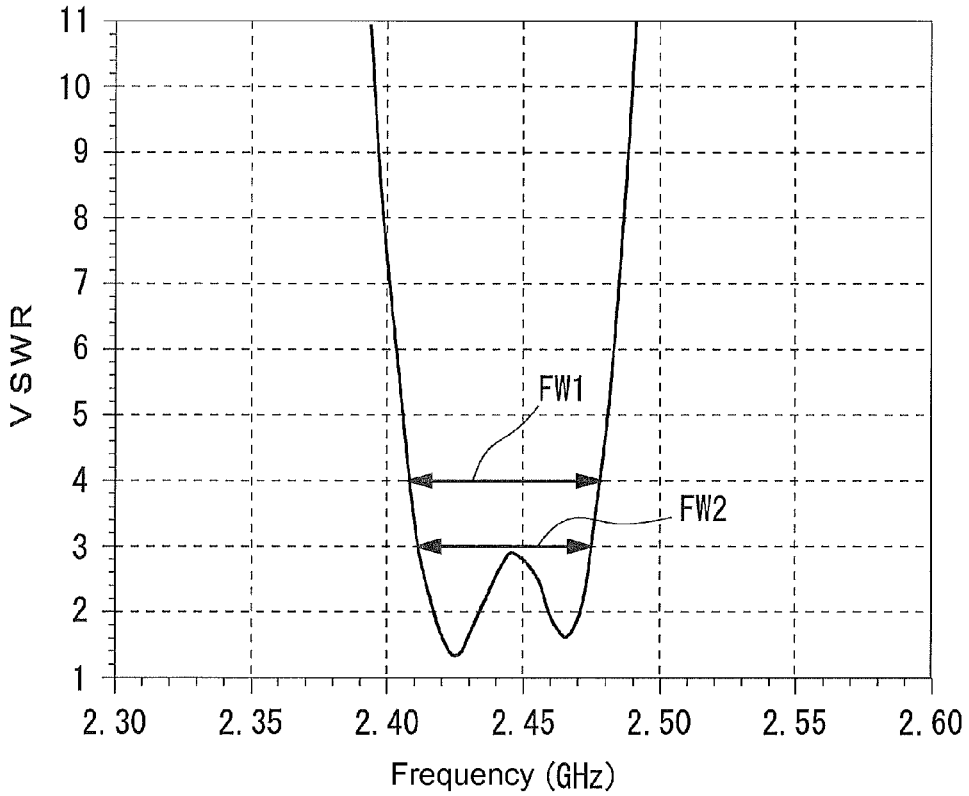
FIG. 7 shows the VSWR properties of the chip antenna of Embodiment 1 of the present invention.
Figure 8:
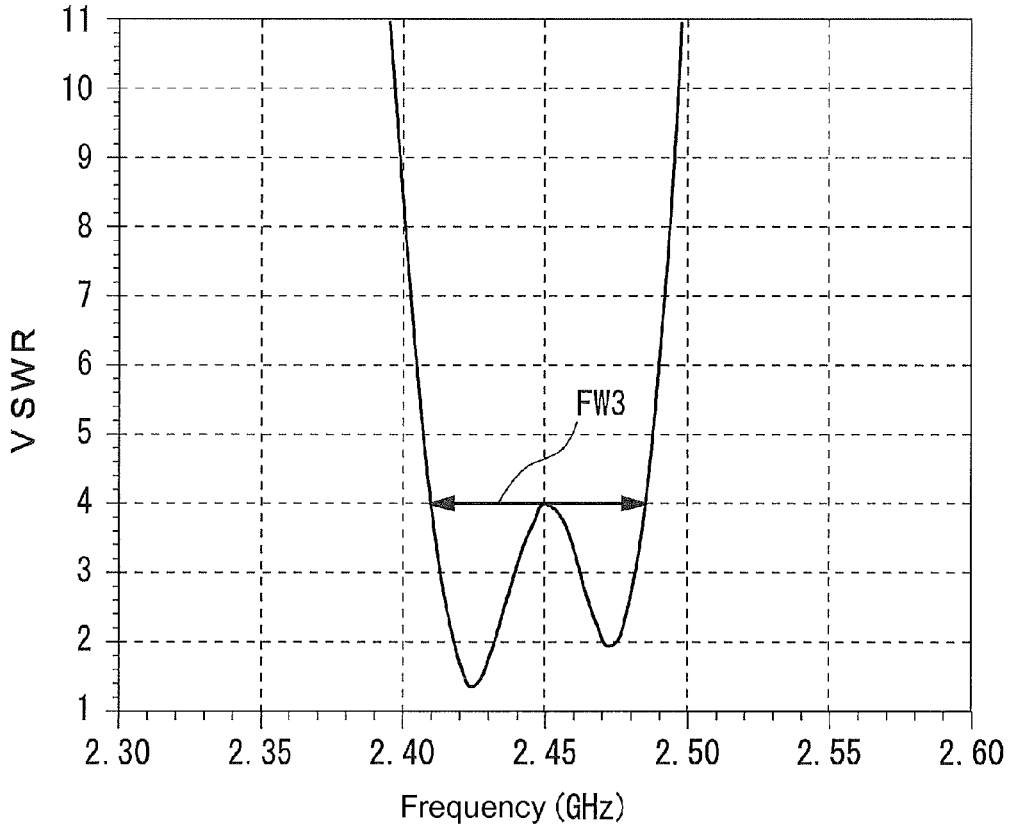
FIG. 8 shows the VSWR properties of the chip antenna of Embodiment 1 of the present invention.

Next, the VSWR properties of the antenna device 1 with the above-mentioned configuration will be described with reference to FIGS. 7 and 8. The data used for the VSWR properties explained here are obtained by electromagnetic field simulation using the finite element method. Also, the VSWR properties shown in FIGS. 7 and 8 are properties after matching was performed with an impedance matching circuit (not shown). VSWR is a parameter to determine the level of impedance matching, in which VSWR=1 signifies a condition of being perfectly-matched and there is no loss. Thus, it is preferable to have a small VSWR value in a wide frequency range.

By appropriately adjusting the bonding amount of the aforementioned first capacitively coupled portion and the second capacitively coupled portion, the VSWR band can be appropriately adjusted.

FIG. 7 is an example in which adjustments were made so that the band in which VSWR<3 becomes large, and FIG. 8 is an example in which adjustments were made so that the band in which VSWR<4 becomes large. In the example in FIG. 7, the frequency bandwidth FW1 is 69 MHz where VSWR=4, and the frequency bandwidth FW2 was 63 MHz where VSWR=3. Also, in the example in FIG. 8, the frequency bandwidth FW3 is 74 MHz where VSWR=4.

According to the antenna device 1 of the present embodiment, it can be seen that compared to the aforementioned conventional example, an excellent impedance matching can be obtained in a wider frequency band, and an excellent antenna characteristics can be obtained in a wide frequency band.

Also, according to the antenna device 1 of the present embodiment, the frequency range in which excellent impedance can be obtained can be widened without increasing the area that the antenna device 1 occupies on the substrate 2.

Next, Embodiment 2 of the present invention will be described.

Figure 9:
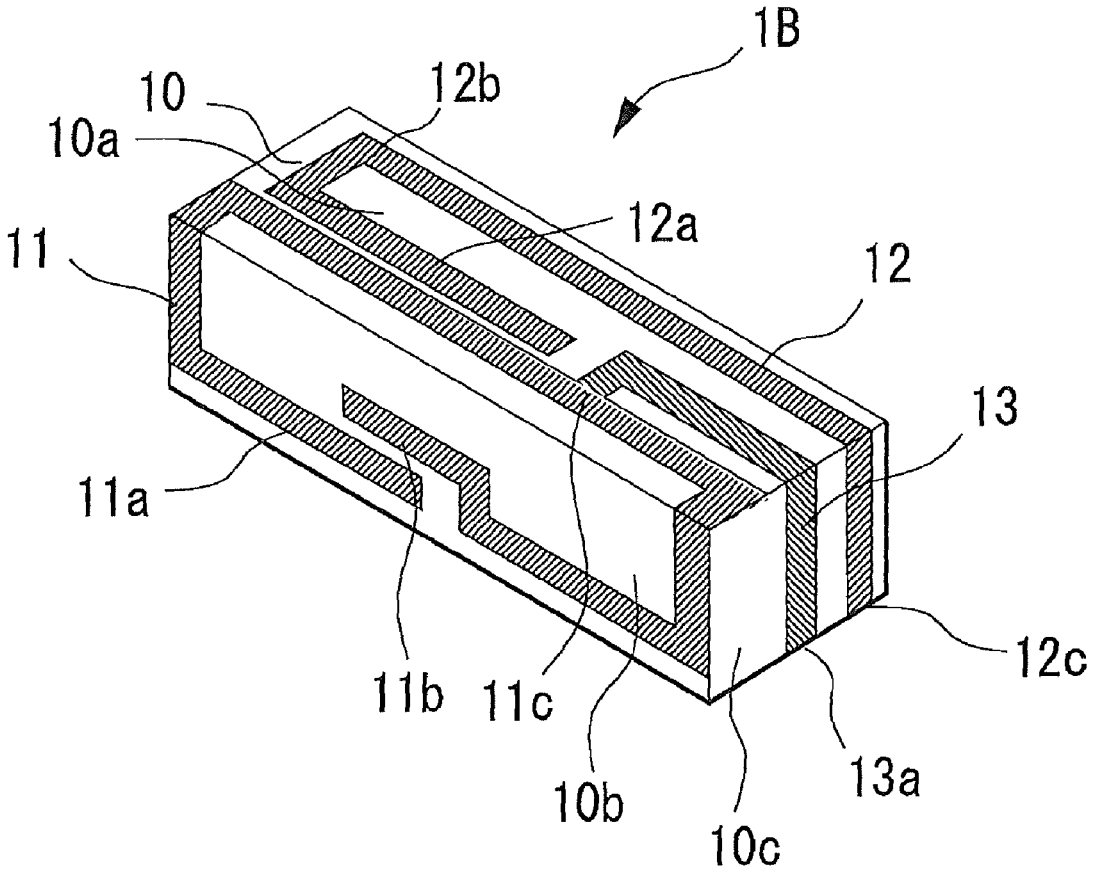
FIG. 9 is an exterior perspective view showing a chip antenna of Embodiment 2 of the present invention.
Figure 10:
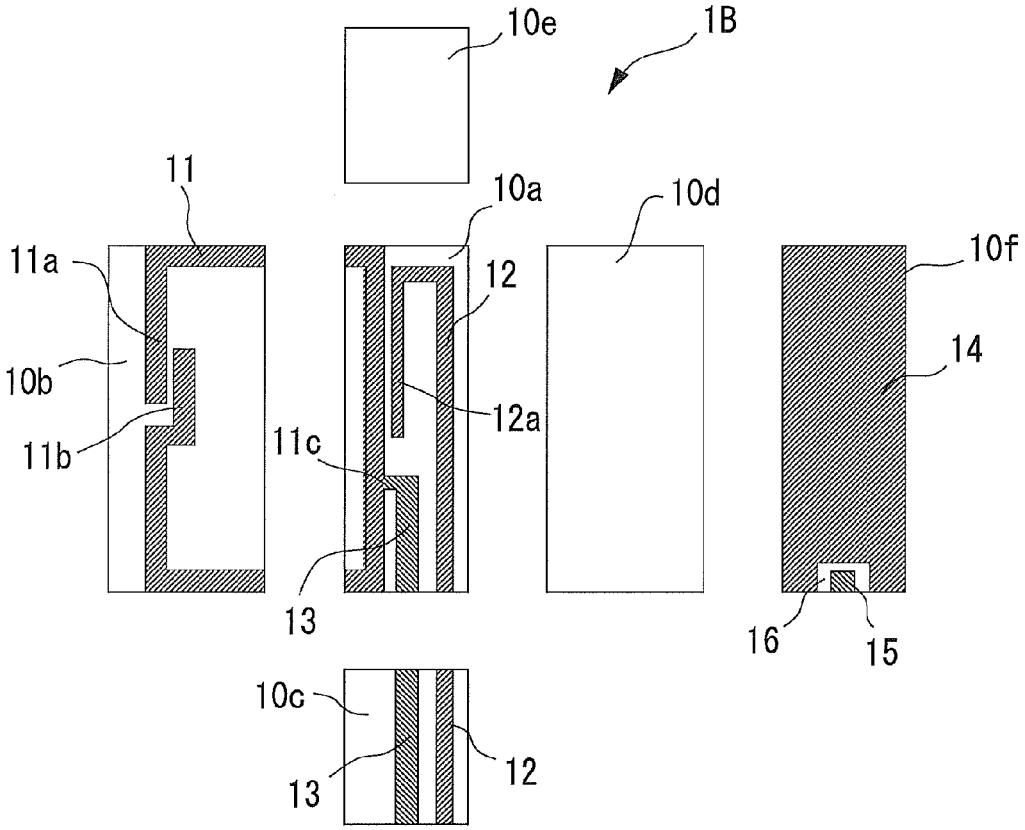
FIG. 10 is an expansion plan showing each surface of the chip antenna of Embodiment 2 of the present invention.

In FIGS. 9 and 10, the same components as in Embodiment 1 are assigned the same reference characters and descriptions thereof will be omitted.

Furthermore, the difference between the antenna device 1 of Embodiment 1 and an antenna device 1B of Embodiment 2 is that the second capacitively coupled portion of a first radiating electrode 11 and a second radiating electrode 12 is formed on a top surface 10*a* of a block 10. Thus, one side of the loop-shaped conductor of the first radiating electrode 11 is formed on the top surface 10*a* of the block 10, and an open end portion 12*a* of the second radiating electrode 12 is arranged in parallel through a slit on a portion of the first radiating electrode 11 formed on the top surface 10*a*.

Arranging a portion of the loop-shaped conductor of the first radiating electrode 11 on the top surface 10*a* of the block 10 in this manner is effective when enough inductance cannot be obtained because the height of the block 10 and the length of the linear conductor of the first radiating electrode 11 are short. The reason will be described below.

As for the method of manufacturing, a method to print silver paste using a printing mask for the surfaces 10*a* to 10*f* of the block 10 is used, and specialized printing masks are prepared for each surface 10*a* to 10*f* and are sequentially printed. In this case, in order to accurately form a narrow gap such as the first and second capacitively coupled portions, it is preferable that the components (lines facing each other) are arranged on the same surface and in the same step. If these are arranged on different surfaces, that means that there is a plurality of steps for forming the gap, which generates a problem in which the manufacturing accuracy decreases and variation is caused in antenna characteristics.

In the aforementioned Embodiment 1, the above-mentioned problem does not occur because the first radiating electrode 11 and the second capacitively coupled portion is arranged on the other side face 10*b* of the block 10, and the constituting elements of the gap are included in one printing mask.

However, if the height of the block 10 becomes lower, the area of the other side face 10*b* decreases, and if the first radiating electrode 11 and the second capacitively coupled portion are arranged as in Embodiment 1, then it will be difficult to obtain enough inductance to make the desired adjustments to the frequency band. Thus, one side of the loop-shaped conductor of the first radiating electrode 11 is arranged on the top surface 10*a* of the block 10, and the second capacitively coupled portion is also arranged on the top surface 10*a* of the block 10. Then, only the main portion of the three sides of the loop-shaped conductor of the first radiating electrode 11 needs to be arranged on the other side face 10*b*, therefore it will be easier to obtain enough inductance to make the desired adjustments to the frequency band. Also, the manufacturing accuracy does not decrease because the constituting elements of the second capacitively coupled portion are arranged on only the top surface 10*a* of the block 10 and the constituting elements of the gap are formed in the same step.

Figure 11:
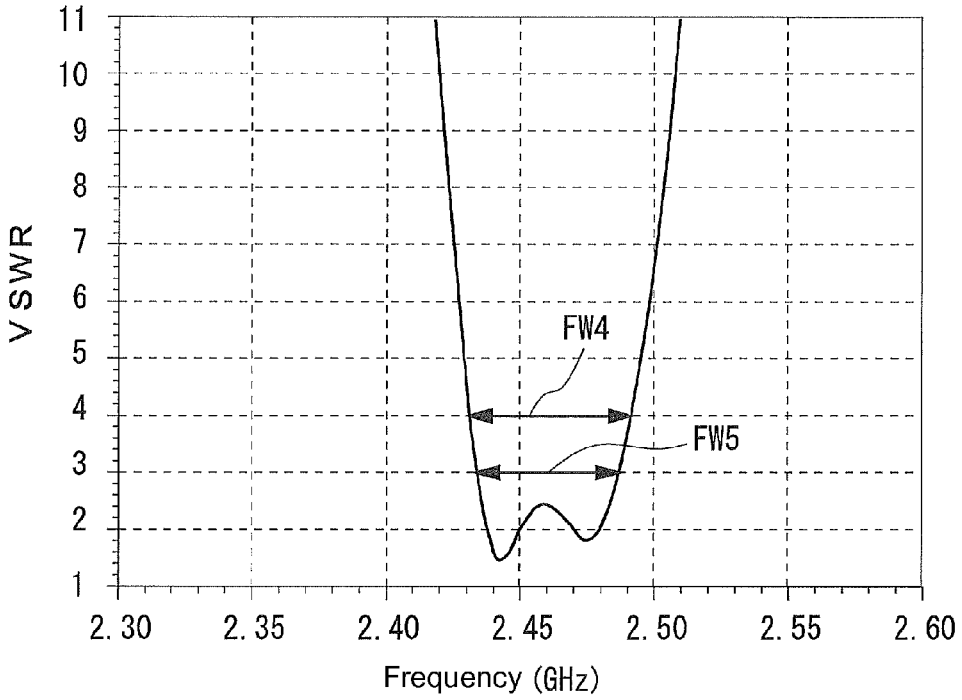
FIG. 11 shows the VSWR properties of the chip antenna of Embodiment 2 of the present invention.
Figure 12:
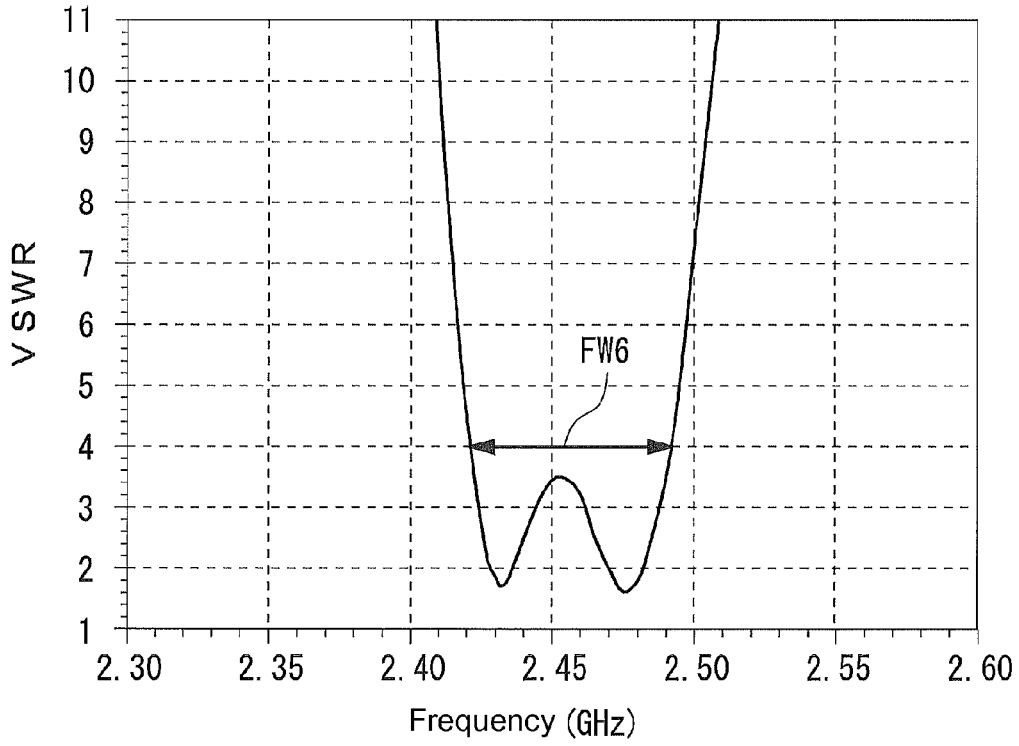
FIG. 12 shows the VSWR properties of the chip antenna of Embodiment 2 of the present invention.

The VSWR properties of the antenna device 1B when mounted on the substrate 2 similar to the one in Embodiment 1 are shown in FIGS. 11 and 12. The data used for the VSWR properties explained here are obtained by electromagnetic field simulation using the finite element method. Also, the VSWR properties shown in FIGS. 11 and 12 are properties after matching was performed with an impedance matching circuit (not shown).

By appropriately adjusting the bonding amount of the aforementioned first capacitively coupled portion and the second capacitively coupled portion, the VSWR band can be appropriately adjusted in Embodiment 2 as in Embodiment 1.

FIG. 11 is an example in which adjustments were made so that the band in which VSWR<3 becomes large, and FIG. 12 is an example in which adjustments were made so that the band in which VSWR<4 becomes large. In the example in FIG. 11, the frequency band FW4 is 60 MHz where VSWR=4, and the frequency band FW5 was 53 MHz where VSWR=3. Also, in the example in FIG. 12, the frequency band FW6 is 70 MHz where VSWR=4.

As can be seen, the antenna device 1B of Embodiment 2 can also obtain an excellent impedance matching in a wider frequency band compared to a conventional example as in Embodiment 1, and excellent antenna characteristics can also be obtained in a wide frequency band.

Also, the antenna device 1B of Embodiment 2 can widen the frequency range in which excellent impedance matching can be obtained without increasing the area of the substrate 2 that the antenna device 1B occupies.

Figure 13:
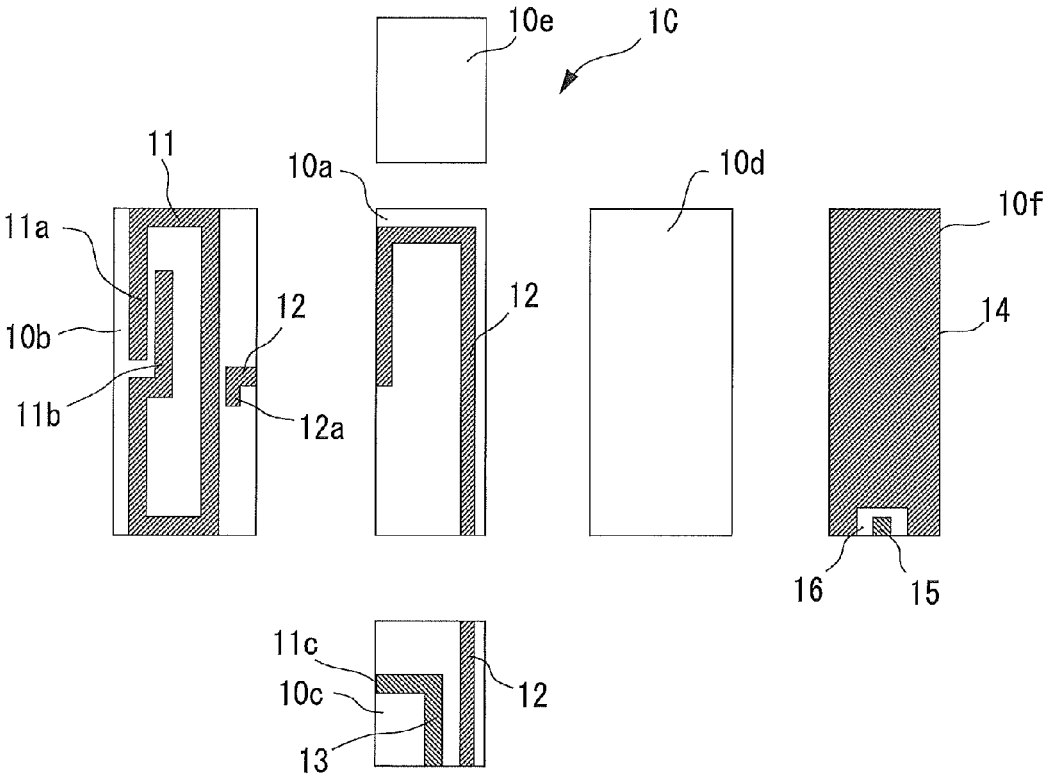
FIG. 13 is an expansion plan showing another example of a configuration of the chip antenna of the present invention.
Figure 14:
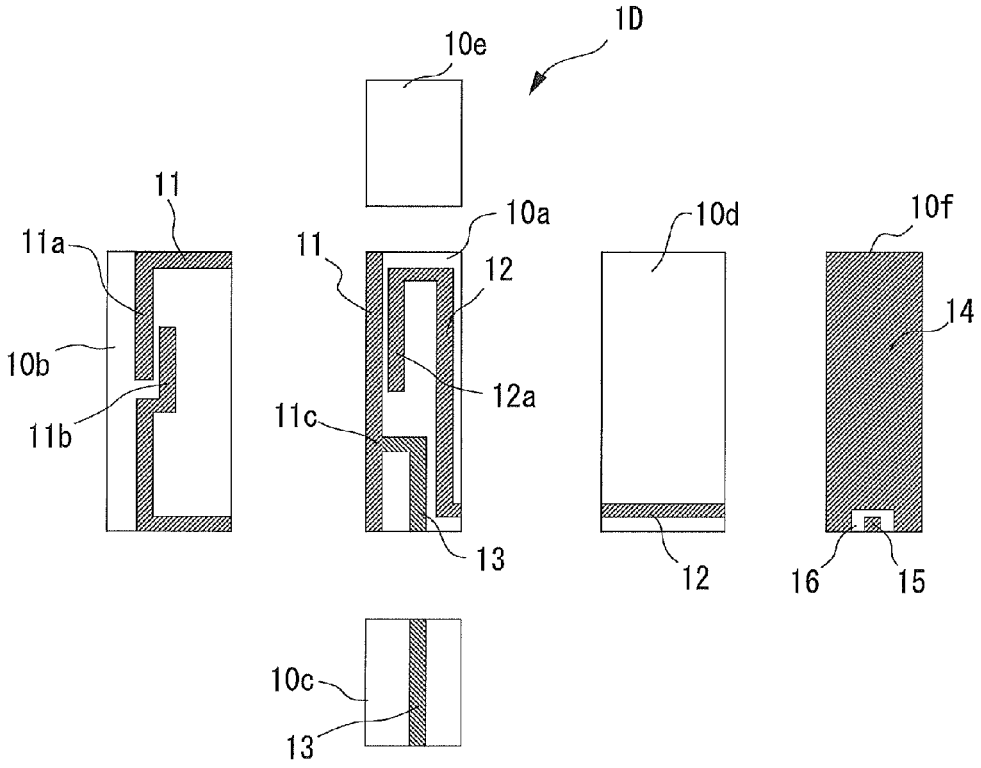
FIG. 14 is an expansion plan showing another example of a configuration of the chip antenna of the present invention.
Figure 15:
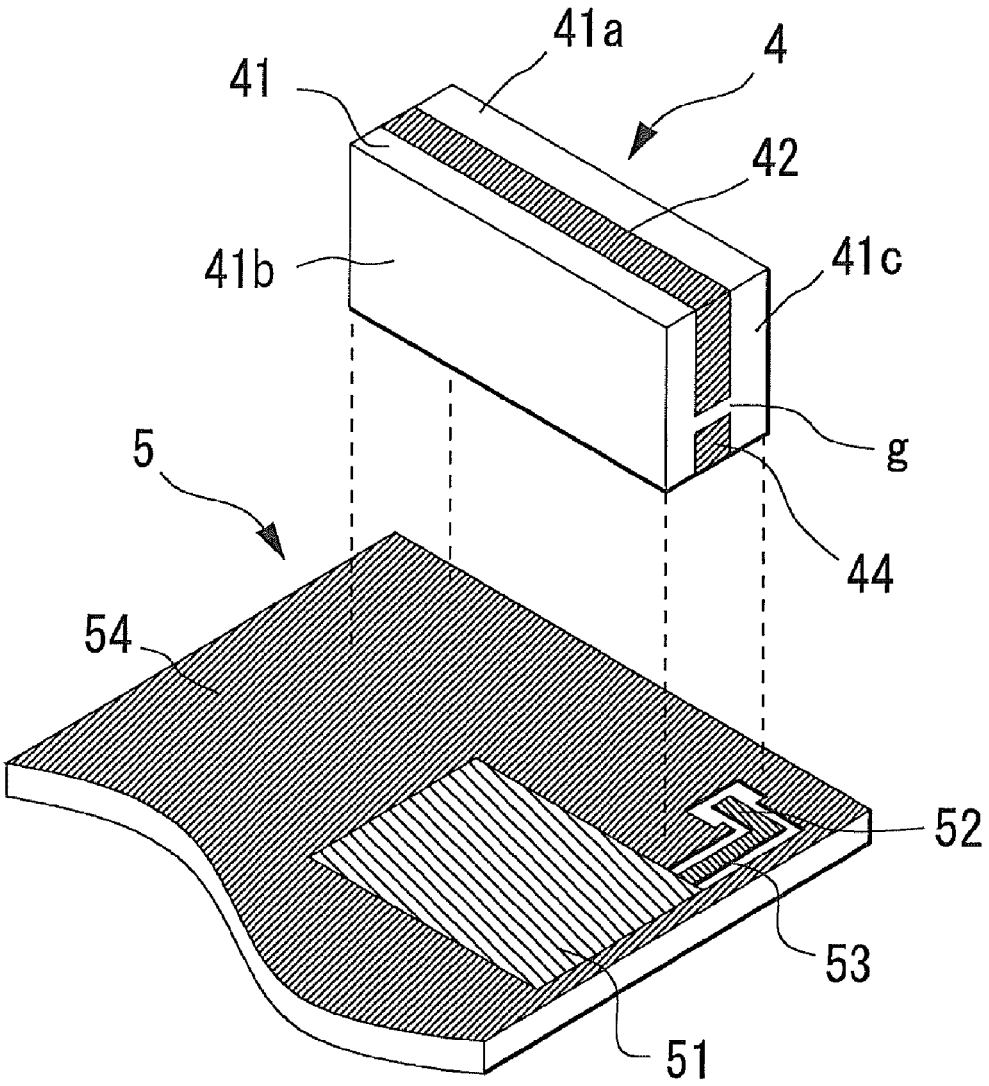
FIG. 15 shows an example of a conventional method of installing a communication circuit substrate for transmission and reception of a chip antenna.
Figure 16:
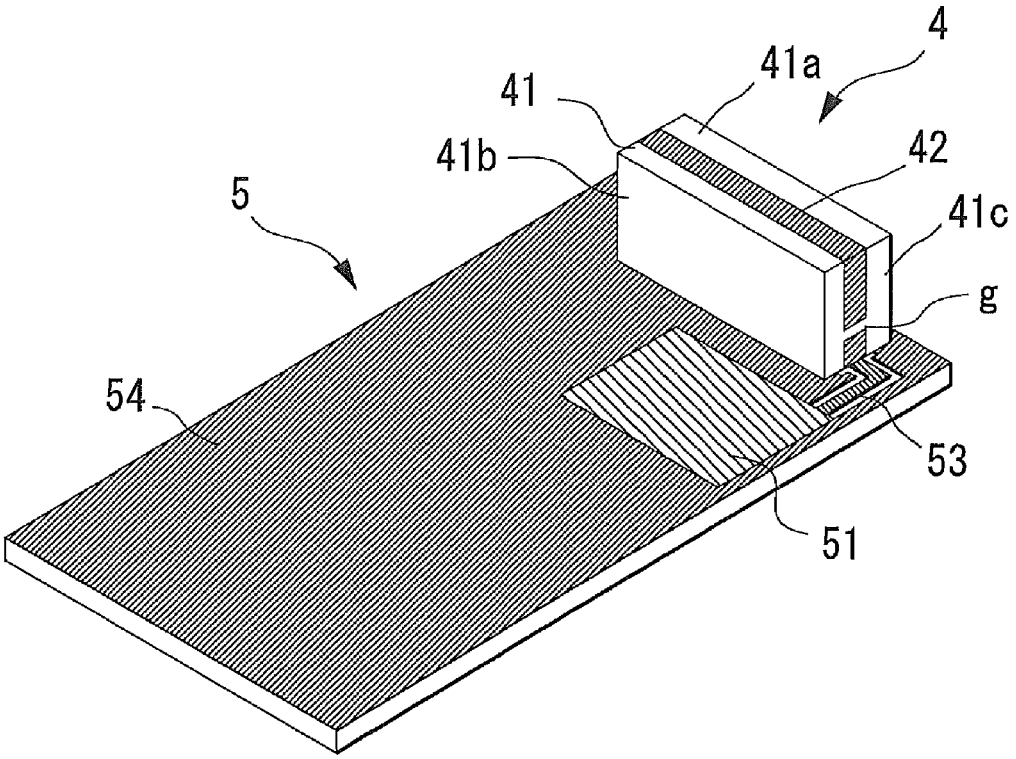
FIG. 16 is an exterior perspective view showing a conventional configuration of a communication circuit substrate for transmission and reception installed with a chip antenna.
Figure 17:
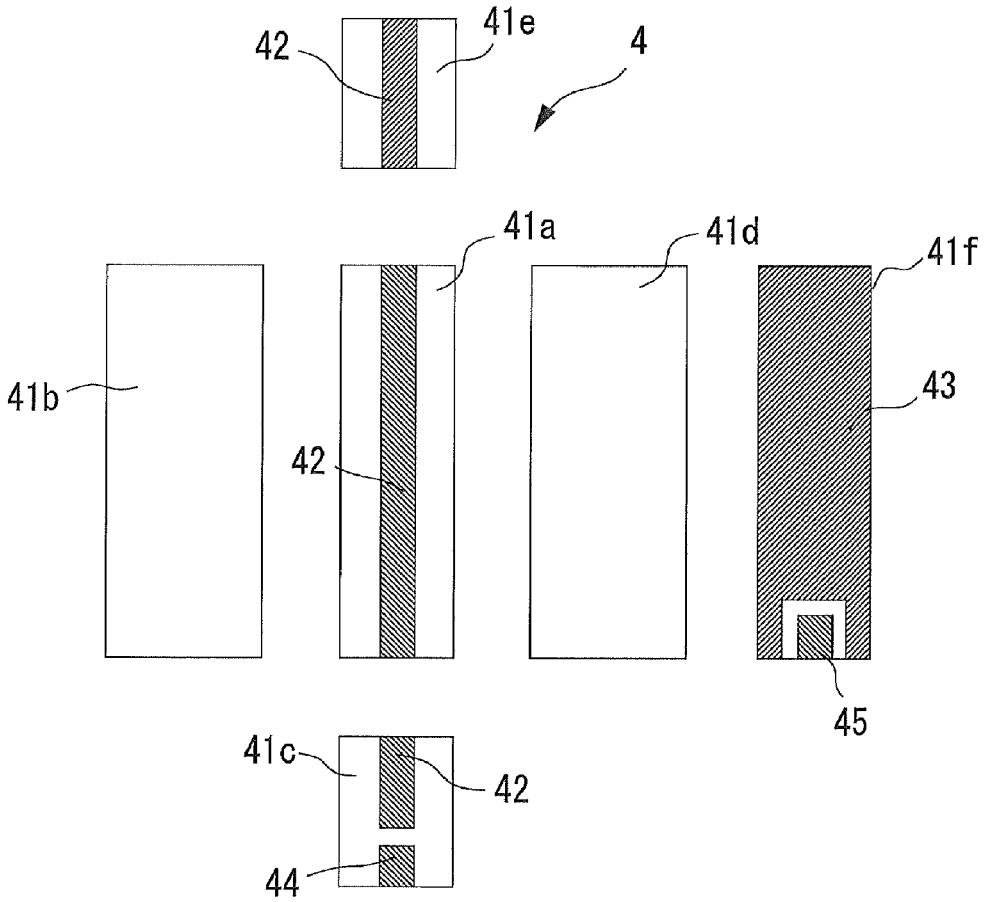
FIG. 17 is an expansion plan showing each surface of a configuration of a conventional chip antenna.
Figure 18:
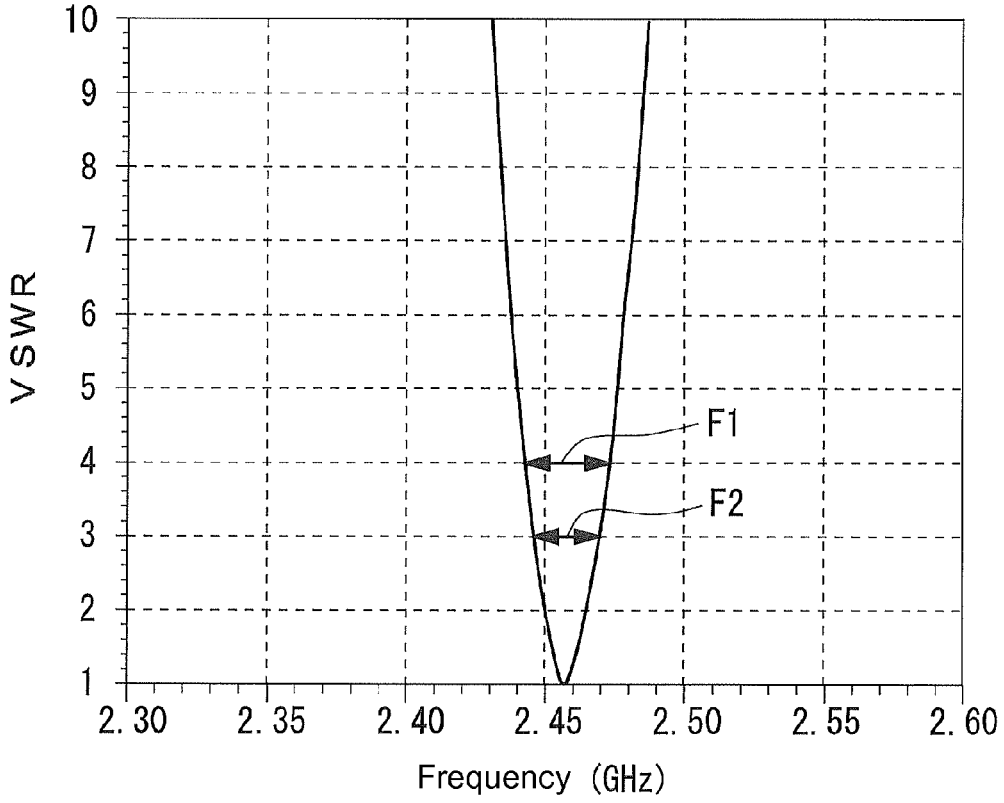
FIG. 18 shows the VSWR properties of a conventional chip antenna.

Additionally, the arrangement of the first radiating electrode 11, the second radiating electrode 12, the excitation electrode 13, and the like is not limited to the configuration of the above-mentioned embodiments. The configurations of the electrodes of antenna devices 1C and 1D shown in FIGS. 13 and 14 can also achieve similar effects, for example. The excitation electrode 13 in the configuration of the antenna device 1C shown in FIG. 13 does not extend to the top surface 10*a* of the block 10 and is connected to a prescribed position 11*c* of the first radiating electrode 11 formed on the side face 10*c* adjacent to the side face 10*c*. Also, the configuration of the electrode of the antenna device 1D shown in FIG. 14 is similar to the configuration of the above-mentioned Embodiment 2 in which the first radiating electrode 11 is formed on the top surface 10*a* along a side in contact with the other side face 10*b*.

Also, while the antenna devices 1, 1B, 1C, and 1D for frequency bands of 2.4 Ghz and the communication circuit substrate for transmission and reception 2 were used as examples in the above-mentioned embodiments, the frequency band is not limited to 2.4 GHz and using other frequency bands will also have similar effects.

INDUSTRIAL APPLICABILITY

The present invention is a chip antenna with a ground installed and a communication circuit substrate for transmission and reception with the antenna device mounted that can be widely used for wireless LAN, Bluetooth, cell phones, and the like and can set a wide frequency range in which excellent impedance matching can be obtained, and the frequency range in which excellent impedance matching can be obtained can be widened without increasing the area that the antenna device occupies on the circuit substrate.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A chip antenna, comprising:

a block having a rectangular cuboid shape;

a feed terminal pad formed on a rectangular bottom surface of the block at a short side of said rectangular bottom surface;

a ground electrode formed on an area on the bottom surface of the block;

an electrically insulated area formed on the bottom surface of the block so as to separate the feed terminal pad with the ground electrode;

an excitation electrode that has one end on a narrower side face, among side faces, of the block, the end being connected to the feed terminal pad on the bottom surface, the excitation electrode extending from a bottom portion of said narrower side face of the block towards a top surface of the block;

a first radiating electrode of a split ring resonator type having two open ends, the first radiating electrode having a capacitively coupled portion formed by arranging two open end portions defining a first slit on a wider side face, among the side faces, of the block that is adjacent to said narrower side face, the first radiating electrode having a prescribed portion connected to another end of the excitation electrode, said two end portions of the first radiating electrode that define said first slit, forming the capacitively coupled portion, are entirely on said wider side face of the block;

a second radiating electrode having two ends, one end being connected to the ground electrode and another end being open, and in which at least a central portion of the second radiating electrode is formed on the top surface of the block and an open end portion of the second radiating electrode forms a second slit with a portion of the first radiating electrode so as to form a capacitively coupled portion between said portion of the first radiating electrode and said open end portion of the second radiating electrode, wherein said first slit formed by said two end portions of the first radiating electrode and said second slit formed by the open end portion of the second radiating electrode and said portion of the first radiating electrode respectively have uniform gaps and extend in a direction parallel to a longitudinal direction of the block, and wherein a resonance frequency of the first radiating electrode and a resonance frequency of the second radiating electrode are different from each other.

2. The chip antenna according to claim 1, wherein the first radiating electrode is arranged so that the two open end portions are parallel to each other with the first slit therebetween, and the capacitively coupled portion is formed between said two open end portions.

3. The chip antenna according to claim 1, wherein the second radiating electrode has a U-shaped turn portion and is connected to the ground electrode through the open end of the second radiating electrode and the U-shaped turn portion.

4. The chip antenna according to claim 1, wherein the portion of the first radiating electrode forming the capacitively coupled portion with the second radiating electrode and the open end of the second radiating electrode are formed on the top surface of the block so that the capacitively coupled portion is formed between the first radiating electrode and the second radiating electrode on the top surface of said block.

5. The chip antenna according to claim 1, wherein the first radiating electrode and the open end portion of the second radiating electrode are formed on said wider side face of the block so that the capacitively coupled portion between the first radiating electrode and the second radiating electrode is formed on said wider side face of the block.

6. A communication circuit substrate for transmission and reception, comprising a ground electrode on a surface of the communication circuit substrate for transmission and reception, wherein the chip antenna according to claim 1 is mounted on the communication circuit substrate for transmission and reception so that the ground electrode of the chip antenna and the ground electrode of said substrate are electrically connected.

* * * * *